United States Patent [19]

Will et al.

[11] Patent Number: 4,541,128

[45] Date of Patent: Sep. 17, 1985

[54] DISPOSABLE BONNET RAINCOAT

[76] Inventors: Neal Will, Rte. 3, Ravenwood Cir., Piedmont, S.C. 29673; Larry R. Thurston, Rte. 2, Pelzer, S.C. 29669

[21] Appl. No.: 605,417

[22] Filed: Apr. 30, 1984

[51] Int. Cl.[4] ..... A41D 10/00

[52] U.S. Cl. ..... 2/84; 2/82

[58] Field of Search ..... 2/82, 84, 87, 88, 89, 2/80

[56] References Cited

U.S. PATENT DOCUMENTS 3,946,443 3/1976 Knight ..... 2/82

4,313,229 2/1982 Villafane ..... 2/82

*Primary Examiner*—Doris L. Troutman

*Attorney, Agent, or Firm*—Cort Flint

[57] ABSTRACT

A disposable bonnet raincoat and method is disclosed which includes a tubular length of plastic material (10) which is folded upon itself to define interior flaps (20) and (24) and exterior flaps (18) and (16). At a fold line (30) of the interior flaps (20) and (24) there is an elongated slot (C) through which the head of the wearer protrudes to define a bonnet (A) for protecting the head of the wearer. The remainder of the tubular plastic sheeting provides a protective apron (B) around the body of the wearer in which he may sit or stand for protection against the weather.

18 Claims, 6 Drawing Figures

Fig. 3.
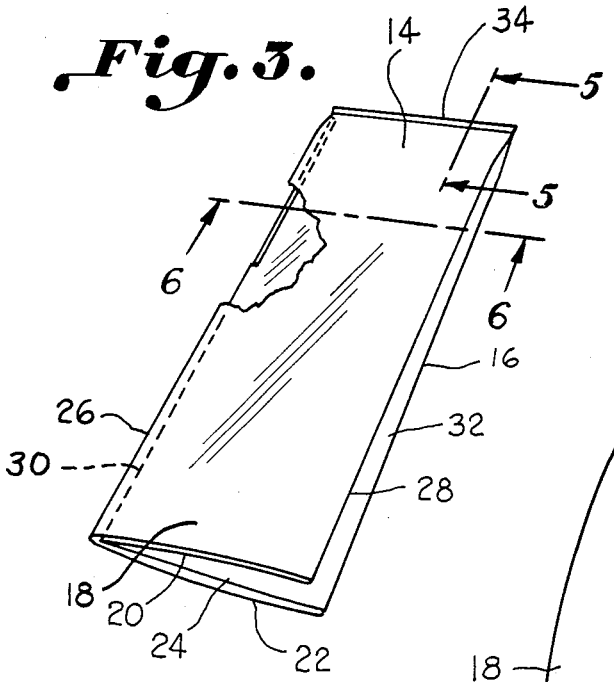
Fig. 4.
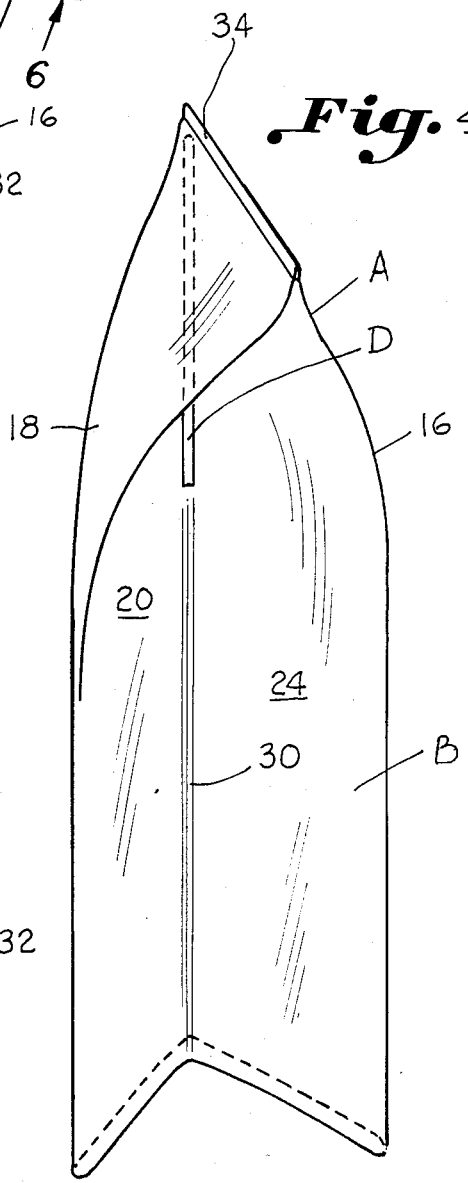
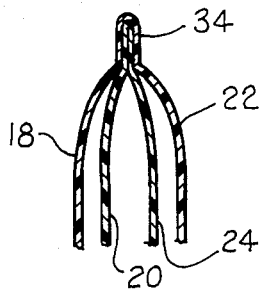
Fig. 5.
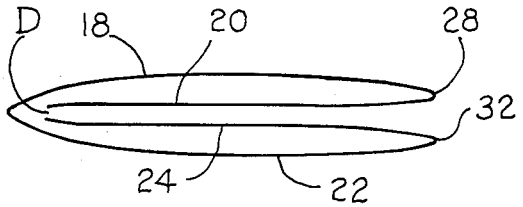
Fig. 6.

DISPOSABLE BONNET RAINCOAT

BACKGROUND OF THE INVENTION

The invention relates to a disposable raincoat garment having a construction which forms a bonnet over the head of the wearer to protect him from rain and the like while the raincoat is draped over his body to cover the wearer.

Heretofore, numerous disposable raincoats have been proposed which are formed by folding and seaming various types of materials to make a rain protector as shown in U.S. Pat. Nos. 4,313,229, 2,911,651, 2,756,431, and 1,603,501.

While these rain protectors and coats provide satisfactory protection against the rain, the processes and materials required for manufacturing of the same ordinarily do not lend themselves to the manufacturing of disposable rain protectors which are sufficiently protective yet economical to make them affordable on a disposable basis.

Accordingly, an important object of the present invention is to provide a disposable raincoat and protector which is economical to manufacture and may be afforded as a disposable garment.

Still another important object of the present invention is to provide a disposable raincoat structure having a bonnet which forms a roof over the face of the wearer and protection against rain and the like.

Still another important object of the present invention is to provide a raincoat garment which is readily affordable as a disposable garment and yet has a reliable bonnet for protecting the head and face of the wearer and a main coat section which fits substantially over the body of the wearer.

Still another important object of the present invention is to provide a unique method of forming a disposable raincoat by folding waterproof material upon itself and forming seams which convert a simple tubular stock of material into a disposable raincoat.

SUMMARY OF THE INVENTION

The above objectives are accomplished according to the present invention by a tubular sheet of material having an open interior bounded by sheeting which is folded upon a center line to provide two folded sides. Each side includes an exterior flap and an interior flap. The junction of the two interior flaps of the two sides includes an elongated slit along a rear fold of the interior flaps. The interior and exterior flaps of both sides are seamed together along the top of the folded sheeting. As the interior of the tubular fabric is received over the body of the wearer, the head of the wearer extends through the elongated slit. A bonnet is formed by side gussets as the flaps unfold when the head is received through the slit opening. The interior and exterior flaps form a two-ply reinforced bonnet structure while the interior flaps unfold to form a front cover and the exterior flaps form a rear cover. Thus, a simplified and effective rain protector is provided in accordance with the present invention which may be easily manufactured and afforded as a disposable raincoat for athletic events and other outdoor events at which inclement weather may arise.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 3 and FIG. 6 are a perspective view illustrating a disposable bonnet raincoat and method for making the same in accordance with the present invention;

FIG. 4 is a front perspective view illustrating a disposable bonnet raincoat and method for the same in accordance with the invention; and FIG. 5 is a perspective view with parts cut away showing the folded sides and exterior and interior flaps of a disposable raincoat structure and method in accordance with the present invention.

DESCRIPTION OF A PREFERRED EMBODIMENT

Figure 1:
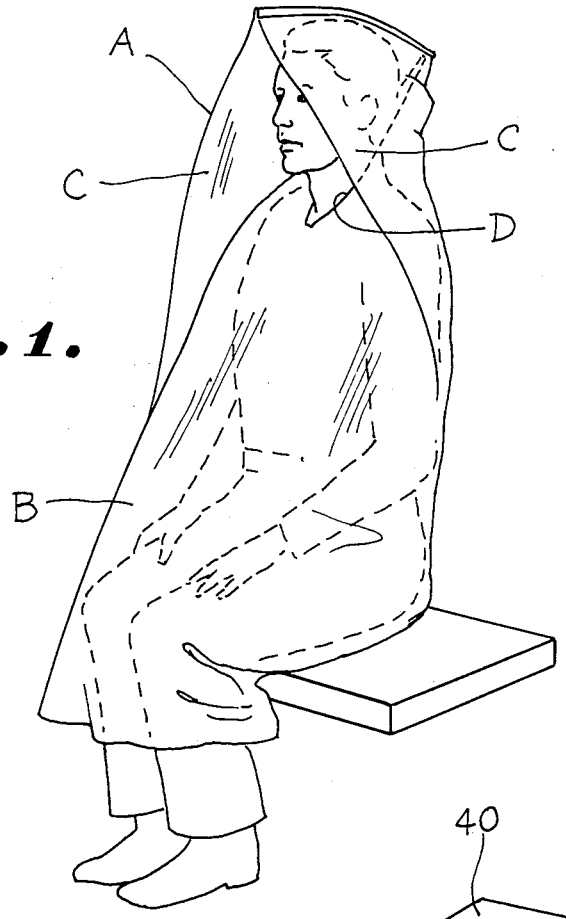
FIG. 1 is a perspective view illustrating a disposable bonnet raincoat being worn as constructed in accordance with the present invention.
Figure 2:
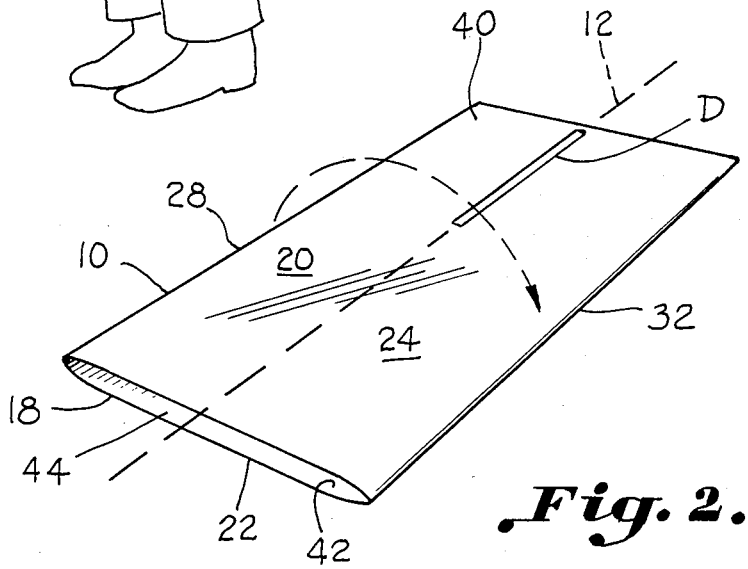
FIG. 2 is a perspective view illustrating a disposable bonnet raincoat and method according to the invention.

Referring now in more detail to the drawings, a disposable bonnet raincoat is illustrated which includes a bonnet portion A and a body covering apron portion B. Side gussets C form the bonnet B as the raincoat is unfolded and worn.

The disposable raincoat is formed from a tubular length of plastic sheeting 10 which may be a one-piece tubular piece of material or a piece of material which is folded upon itself and seamed. The sheeting is folded upon a center line 12 to provide a first side 14 and a second side 16. The first side 14 includes an exterior flap 18 and an interior flap 20. The second side of the disposable raincoat structure includes an exterior flap 22 and an interior flap 24.

There is an exterior fold 26. The exterior flap 18 extends from the fold toward a front fold 28 wherein it extends back in the form of interior flap 20 to a rear interior fold 30. On the rear fold 30, interior flap 24 extends to a front fold 32. At the front fold 32 the exterior flap 24 terminates and the interior flap 22 continues back to the rear fold 26.

At the top of the folded raincoat structure, there is a heat seal 34 which secures the flaps 18, 20, 22, and 24 together. There is an elongated slit D formed along the interior fold 30 of the inside panel.

Side gussets C are formed as the coat is received over the body of a person due to the unfolding of the side flaps and joinder thereof at 34 along the top. A two-ply bonnet is formed by the side gussets terminating at 34 which consist of the exterior and interior flaps. This facilitates stiffening and standing up of the bonnet in the form of a roof over the wearer's head.

In accordance with the method of the present invention, a disposable bonnet raincoat is formed by providing a length of plastic stock material 10 in tubular form which is open-ended. The stock of material includes an interior panel 40 and an exterior panel 42 which define a hollow interior 44. The interior and exterior panels are joined by the folds 28 and 32, one of which may be a seam instead of a fold, to provide a tubular construction.

Next, the interior panel is folded upon itself to provide the first and second sides 14 and 16. Next, a heat seal is formed along the upper end of the length of sheeting to join the exterior flaps 18 and 22 and the interior flaps 20 and 24 together at the top of the raincoat structure. Slot opening D is formed in fold 30. When the wearer slides the tubular sheeting over his body, the head is extended through the slot D and the side gussets C and bonnet A is formed as the interior panels 20 and 24 are folded outwards to form the front part of the main body cover apron B.

Due to the unique construction of the disposable bonnet raincoat and the method of folding and joining the seams of the tubular sheeting, the bonnet A provides a roof over the head of the wearer which protects the head from rain and the like. In particular, the joining of the interior and exterior flaps at the top of the raincoat structure and the slot along the rear fold of the interior flaps cause a unique bonnet structure to occur in the unfolded raincoat structure when worn. Both the interior and exterior flaps of both sides form a two-ply bonnet portion while the exterior flaps form the back of the raincoat and the interior flaps form the front apron of the raincoat.

Thus it can be seen, that by folding, seaming, and slitting a tubular sheet of plastic material such as polyethylene and the like in accordance with the present invention and forming a seal along the top of the sheeting, a simple, inexpensive, and effective raincoat is provided which is readily affordable as a disposable raincoat.

It will be understood, of course, that while the form of the invention herein shown and described constitutes a preferred embodiment of the invention, it is not intended to illustrate all possible form of the invention. It will also be understood that the words used are words of description rather than of limitation and that various changes may be made without departing from the spirit and scope of the invention herein disclosed.

What is claimed is:

1. A disposable bonnet raincoat to be worn over the head and body of a person for protection from rain and the like comprising:

a tubular piece of waterproof sheeting having an interior opening bounded by said sheeting;

said tubular piece of sheeting being folded upon itself to define first and second opposing folded sides;

said first side including a first exterior flap and a first interior flap;

said second side including a second exterior flap and a second interior flap;

said first and second interior flaps joining together at a junction generally in a medial portion of said tubular piece of sheeting;

an elongated head receiving slot formed along said junction of said interior flaps permitting penetration of the person's head;

said first and second interior flaps and said first and second exterior flaps being joined together adjacent a top of said tubular piece of sheeting;

said folded sheeting unfolding when received over the body of a wearer to create side gussets forming a bonnet in the form of a downwardly sloped roof over the head of the wearer; and said interior and exterior flaps unfolding to generally cover the body of the person.

2. The device of claim 1 wherein said first exterior flap originates at a rear exterior fold and terminates at a first front side fold of said first side, said interior flap originates at said first front fold and terminates at an interior fold of said folded piece of sheeting, said second interior flap originating at said interior fold and terminating at a second front side fold of said second side, and said second exterior flap terminating at said exterior fold.

3. The raincoat device of claim 1 wherein said bonnet is formed by said exterior flaps and said interior flaps underneath said exterior flaps to form a two-ply structure, said interior and exterior flaps separating when unfolded to generally cover the body of the person.

4. The raincoat device of claim 1 wherein said interior flaps and exterior flaps both form said bonnet to form a two-ply structure to provide stiffness in the bonnet of said raincoat device supporting the same more rigidly as a roof to protect against rain and the like.

5. The raincoat device of claim 1 wherein said exterior and interior flaps of said first and second sides are joined together by a heat seal adjacent the top of said tubular piece of folded sheeting.

6. The apparatus of claim 1 wherein said rear exterior fold of said tubular piece of sheeting includes only the exterior flaps of said first and second sides joined together.

7. The raincoat device of claim 1 wherein said interior flaps are joined together by an interior fold which is unattached to the exterior fold where said exterior flaps are joined together.

8. A disposable bonnet raincoat to be worn over the head and body of a person comprising:

a tubular piece of waterproof sheeting having an exterior panel and an interior panel;

said interior and exterior panels being folded upon themselves to define an exterior fold along said folded exterior panel and an interior fold along said folded interior panel;

said exterior and interior folds being unattached along generally the entire length of said panels;

an elongated head receiving slit opening formed along said interior fold of said piece of sheeting for receiving the head of said person; and said folded interior and exterior panels being joined together adjacent a top of said folded piece of sheeting.

9. The raincoat device of claim 8 wherein said interior and exterior panels are folded together and joined adjacent the top of said folded piece of sheeting by a heat seal.

10. The apparatus of claim 9 wherein said elongated head receiving slot terminates short of said heat seal.

11. The raincoat device of claim 8 wherein said interior and exterior panels form a bonnet when said tubular sheeting is worn over the body of the person which protects the head against rain and the like.

12. The raincoat device of claim 11 wherein said unfolded interior and exterior panels form a covering for said body of said person, and said exterior and interior panels form a two-ply bonnet structure so that said bonnet is stiffened against collapse to form a relatively rigid roof over the head of the person to protect the head from rain and the like.

13. The raincoat device of claim 8 wherein said folded interior and exterior panels unfold when said tubular piece of sheeting is worn over the body of a person to form a body cover and side gussets extend from said unfolded cover tapering outwardly and upwardly to form a roof over the head of the wearer extended through said elongated opening.

14. A method of making a disposable bonnet raincoat comprising:

providing a tubular piece of waterproof sheeting:

folding said sheeting in half to form first and second sides having first exterior and interior flaps and second exterior and interior flaps, respectively;

forming a fold at the joinder of said first and second interior flaps;

forming an elongated head receiving slit opening along a medial portion of said interior flaps;

joining said exterior and interior flaps together adjacent an upper portion of said folded piece of sheeting.

15. The method of claim 14 including forming a heat seal to join said exterior and interior flaps together adjacent said top of said folded piece of sheeting.

16. The method of claim 14 including forming a rear fold where said first and second exterior flaps are joined together, and leaving said exterior fold and said interior fold relatively unattached along the length of said first and second sides.

17. The method of claim 14 wherein said tubular piece of waterproof sheeting is provided by utilizing a continuous tubular piece of sheeting.

18. The method of claim 14 wherein said elongated head receiving opening is formed below said joinder of said exterior and interior flaps adjacent the top of said raincoat device.

* * * * *